United States Patent [19]

Chehab et al.

[11] Patent Number: 4,888,977

[45] Date of Patent: Dec. 26, 1989

[54] METHOD OF ASCERTAINING THE RATE OF FLUID FLOW THROUGH THE VENTILATION ZONES OF ROD-SHAPED ARTICLES OF THE TOBACCO PROCESSING INDUSTRY

[75] Inventors: Firdausia Chehab, Hamburg; Franz P. Koch, Schwarzenbek, both of Fed. Rep. of Germany

[73] Assignee: Körber AG, Hamburg, Fed. Rep. of Germany

[21] Appl. No.: 301,537

[22] Filed: Jan. 24, 1989

[30] Foreign Application Priority Data

Jan. 28, 1988 [DE] Fed. Rep. of Germany ..... 3802453

[51] Int. Cl.[4] ..... G01N 15/08

[52] U.S. Cl. ..... 73/38

[58] Field of Search ..... 73/38

[56] References Cited

U.S. PATENT DOCUMENTS

| | | | |
|---|---|---|---|
| 3,948,048 | 4/1976 | Heitmann et al. | 73/41 |
| 4,120,194 | 10/1978 | Reuland | 73/54.2 |
| 4,121,595 | 10/1978 | Heitmann et al. | 131/21 R |
| 4,127,025 | 11/1978 | Mills et al. | 73/38 |
| 4,177,670 | 12/1979 | Heitmann et al. | 73/38 |
| 4,279,144 | 7/1981 | Bolt | 73/38 |
| 4,280,178 | 7/1981 | Reuland et al. | 364/552 |
| 4,662,214 | 5/1987 | Heitman et al. | 73/38 |

*Primary Examiner*—Hezron E. Williams

*Attorney, Agent, or Firm*—Peter K. Kontler

[57] ABSTRACT

The degree of ventilation of ventilation zones in the wrappers of filter cigarettes is ascertained by confining the ventilation zones of successive cigarettes in a chamber during travel through a testing station and by increasing the pressure in the chamber above or by reducing the pressure in the chamber below atmospheric pressure. The pressure at that end of each cigarette which is adjacent the ventilation zone is monitored at the testing station, and the resulting signal is indicative of the degree of ventilation. Such signal can be divided by a signal denoting the pressure in the chamber during testing, and the resulting signal can be multiplied by 100 to obtain a signal which is indicative of the degree of ventilation in percent. The signal which denotes the degree of ventilation can be displayed, used to modify the operation of the apparatus which provides the wrappers of cigarettes with ventilation zones, and/or used to segregate cigarettes with unacceptable ventilation zones from satisfactory cigarettes.

8 Claims, 3 Drawing Sheets

METHOD OF ASCERTAINING THE RATE OF FLUID FLOW THROUGH THE VENTILATION ZONES OF ROD-SHAPED ARTICLES OF THE TOBACCO PROCESSING INDUSTRY

BACKGROUND OF THE INVENTION

The invention relates to improvements in methods of testing rod-shaped articles of the tobacco processing industry. More particularly, the invention relates to improvements in methods of testing rod-shaped articles, such as filter cigarettes, wherein the wrappers are provided with so-called ventilation zones which exhibit a predetermined permeability to air. Still more particularly, the invention relates to improvements in methods of ascertaining the rate of flow of fluids through ventilation zones of rod-shaped articles which are transported, one after the other, through a testing station.

Rod-shaped articles of the tobacco processing industry which are tested in accordance with the method of the present invention can constitute cigarettes, particularly filter cigarettes. However, it is equally possible to test the ventilation zones of other types of rod-shaped articles, namely plain cigarettes, plain or filter cigarillos, plain or filter cigars, cheroots and filter rod sections of unit length or multiple unit length. Though the description which follows will refer primarily to filter cigarettes, it is to be understood that the method of the present invention can be resorted to with equal or similar advantage for the testing of other rod-shaped articles of the tobacco processing industry with wrappers which are provided with ventilation zones.

When the making of rod-shaped articles of the tobacco processing industry is completed, the articles are tested prior to packing, storage or transport to a further processing station. Testing can involve monitoring of the wrappers for the presence of open seams and/or other leaks, for the presence of frayed ends of the wrappers, for the presence of smudges and/or other blemishes on the wrappers, for the absence of filter mouthpieces or tobacco-containing portions in filter cigarettes, cigars or cigarillos, for the hardness of tobacco-containing ends of filter cigarettes, for the presence or absence of printed matter on the wrappers, for deviations of the length and/or diameters of the articles from standard length or diameter, and/or for other potential defects.

It is known to test the wrappers of cigarettes for the presence of leaks and for the degree of ventilation of their ventilation zones (i.e., for the rate of fluid flow through such ventilation zones) by establishing a pressure differential between the interior and the exterior of each tested article. The extent of the pressure differential is an indicator of the condition of tested articles, i.e., it is possible to draw conclusions as to whether or not the rate of fluid flow through the ventilation zone of the tested article is satisfactory and/or whether or not the wrapper of the tested article exhibits any leaks which warrant segregation of such article from other (acceptable) articles. Reference may be had to commonly owned U.S. Pat. No. 4,120,194 granted Oct. 17, 1978 to Reuland.

A drawback of presently known testing methods is that they do not invariably ensure accurate determination of the rate of fluid flow through the ventilation zones, i.e., through perforations which are provided in the wrappers of rod-shaped articles of the tobacco processing industry in order to permit a predetermined quantity of cool atmospheric air to flow through the wrapper and into the column of tobacco smoke which is drawn into the mouth. On the other hand, manufacturers of rod-shaped smokers' articles demand that the degree of ventilation match the prescribed optimum degree so that there exists an urgent need for a method and an apparatus which can carry out such measurements without being unduly affected by other parameters of the tested articles. The present trend is toward so-called light cigarettes wherein the percentage of certain ingredients of tobacco smoke should not exceed accurately determined limits. The degree of ventilation is one of the parameters which can appreciably influence the composition of tobacco smoke.

OBJECTS OF THE INVENTION

An object of the invention is to provide a novel and improved method which can be utilized to ascertain the degree of ventilation of (i.e., the rate of fluid flow through) the so-called ventilation zones, which are provided in the wrappers of filter cigarettes and other rod-shaped articles of the tobacco processing industry, in such a way that the measurements are not affected by other parameters and/or defects of tested articles or are affected less than when the testing is carried out in accordance with heretofore known methods.

Another object of the invention is to provide a method of ascertaining the degree of ventilation at the rate at which rod-shaped articles of the tobacco processing industry issue from a high-speed maker.

A further object of the invention is to provide a novel and improved method of in-line measurement of the degree of ventilation of filter cigarettes or other rod-shaped articles of the tobacco processing industry.

Still another object of the invention is to provide a method which can be carried out in the maker of rod-shaped articles.

SUMMARY OF THE INVENTION

The invention resides in the provision of a method of ascertaining the rate of fluid flow through the ventilation zones of the wrappers of a series of rod-shaped articles of the tobacco processing industry, particularly filter cigarettes, wherein the ventilation zones exhibit a predetermined permeability to fluids (such as air). The method comprises the steps of transporting the articles seriatim in a predetermined direction along a predetermined path, sealing the ventilation zones of successive articles from the surrounding atmosphere not later than in a predetermined portion of the path, applying to the sealed ventilation zones an external pressure which differs from atmospheric pressure, monitoring the pressure at one end of each of the series of articles in the predetermined portion of the path, and generating signals which denote the monitored pressure. Such signals are indicative of the rate of fluid flow through the respective ventilation zones.

The sealing step preferably comprises confining the ventilation zones of successive articles in a chamber, and the pressure applying step then includes maintaining the interior of the chamber at a pressure which is above or below atmospheric pressure. This induces the flow of air from the ventilation zone to the one end of the article or in the opposite direction, depending upon selected pressure in the chamber.

The sealing step can comprise confining the ventilation zones of successive articles in the chamber and sealing the chamber from the atmosphere when the articles therein reach the predetermined portion of the path.

Alternatively, the sealing step can comprise confining the ventilation zones of successive articles in the chamber before the articles reach the predetermined portion of the path. This renders it possible to select the pressure applying step in such a way that the pressure in the chamber is changed already while an article having its ventilation zone in the closed chamber is being transported toward the predetermined portion of the path.

The method can further comprise the steps of monitoring the external pressure, generating second signals denoting the monitored external pressure, and converting the second signals and the corresponding signals denoting the pressure at the ends of the respective articles into third signals which denote the rate of fluid flow through the ventilation zones. The converting step can include determining the rate of fluid flow in accordance with the equation $$V = P_P/P_K.100\%,$$

wherein V is the third signal (i.e., the rate of fluid flow through a ventilation zone in percent), $P_P$ is the monitored pressure at the ends of the articles, and $P_K$ is the monitored external pressure.

The pressure applying step can include applying to the sealed ventilation zones a predetermined constant pressure. The rate of fluid flow through the ventilation zones is then determined in accordance with the equation $$V = P_P/K.100\%,$$

wherein V is the rate of fluid flow in percent, $P_P$ is the monitored pressure at the ends of the articles, and K is a constant denoting the selected constant pressure.

As a rule, a first end of each article (such as a filter cigarette) is nearer to and the second end is more distant from the respective ventilation zone. The step of monitoring the pressure at the one end of each article preferably includes monitoring the pressure at the first end of each article.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
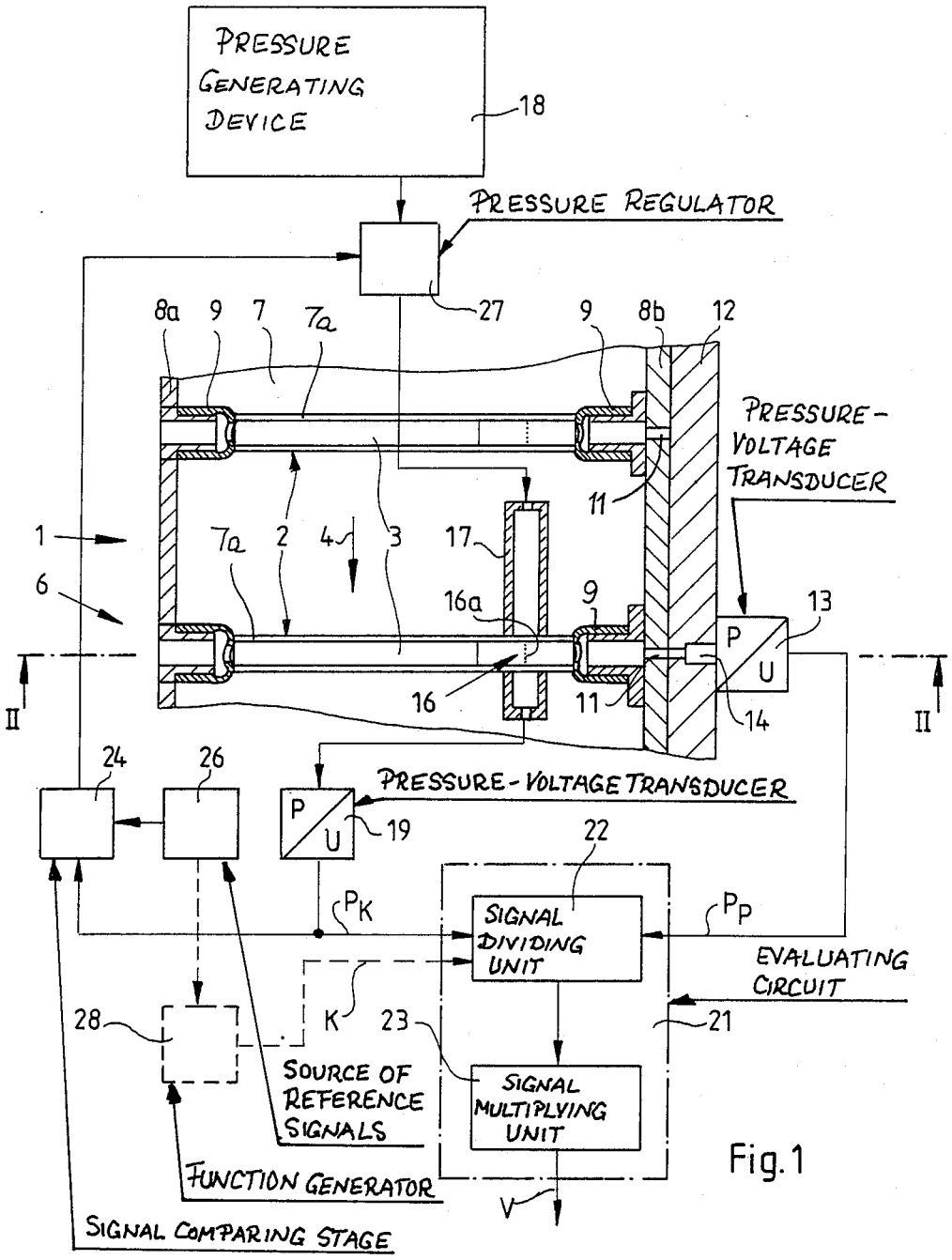
FIG. 1 is a fragmentary partly plan, partly sectional and partly diagrammatic view of a testing apparatus which can be utilized for the practice of the improved method.

FIG. 1 shows a rotary testing conveyor 1 having axially parallel equidistant flutes 2 for rod-shaped articles 3 which are to be tested during travel through a testing station 6. The articles 3 to be tested are filter cigarettes which are caused to advance in the direction of arrow 4, i.e., at right angles to their respective axes. The testing conveyor 1 comprises a drum-shaped body 7, the peripheral surface which is provided with the flutes 2 for articles 3, and two disc-shaped tilting or wobble plates 8a, 8b which are adjacent the axial ends of the drum-shaped body 7. The plates 8a, 8b constitute carriers of sealing elements 9 which register with the adjacent ends of the flutes 2 and engage the respective ends of articles 3 during travel past the testing station 6. The plate 8b is formed with bores or holes 11 which are aligned with the respective sealing elements 9 and advance along the inner side of a stationary shoe 12 in the frame of the testing apparatus. A second shoe 12a (FIG. 2) is adjacent the outer side of the plate 8a. The shoe 12 supports a pressure-voltage transducer 13 which monitors the pressure at the respective ends of successive articles 3 at the testing station 6 and generates signals $P_P$ which are indicative of the monitored pressure. A bore 14 in the shoe 12 registers for short intervals of time with successive holes 11 of the plate 8b in order to enable the transducer 13 to ascertain the pressure in the adjacent end portion of the corresponding article 3 and to generate a signal $P_P$ which is indicative of the monitored pressure. Each sealing element 9 has a membrane which engages the respective end of the article 3 in the aligned flute 2 and has an aperture to ensure that the pressure in the end of the article is the same as in the interior of the sealing element. Such sealing elements are known and are described and shown in numerous United States and foreign patents of the assignee of the present application. Reference may be had, for example, to commonly owned U.S. Pat. No. 3,948,084 granted Apr. 6, 1976 to Heitmann et al.

Figure 2:
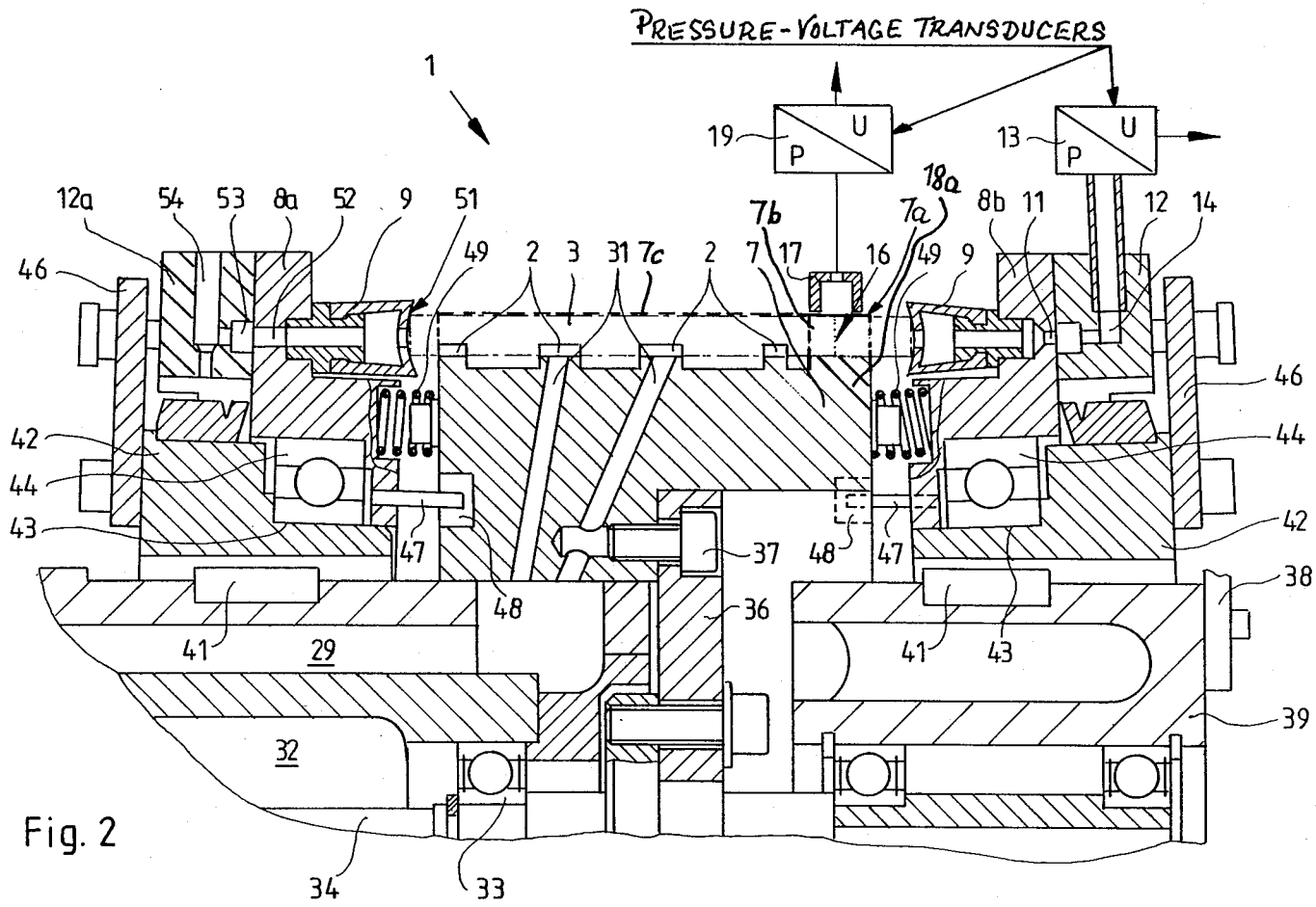
FIG. 2 is an enlarged fragmentary sectional view substantially as seen in the direction of arrows from the line II—II of FIG. 1 or FIG. 3.

The testing apparatus of FIGS. 1 and 2 further comprises a chamber 17 which can constitute a plenum chamber or a suction chamber and is disposed at the testing section 6 to seal the so-called ventilation zones 16 of successive articles 3 from the atmosphere during monitoring of pressure at the right-hand ends of such articles. The illustrated chamber 17 is assumed to be a plenum chamber, i.e., the pressure therein exceeds atmospheric pressure at least during testing of an article 3 in the flute 2 which advances past the testing station 6. An inlet of the chamber 17 is connected with a pressure generating device 18 (e.g., a blower or fan which has an outlet for compressed air). An outlet of the chamber 17 is connected with a second pressure-voltage transducer 19 which serves to generate electric signals $P_K$ denoting the pressure in the chamber 17 during testing of successive articles 3.

Each ventilation zone 16 is nearer to the right-hand end than to the left-hand end of the respective article 3 and includes one or more annuli of perforations 16a which are provided in the wrapper of the filter mouthpiece of the article 3 and impart to the wrapper a predetermined permeability. The purpose of the testing apparatus is to ascertain the rate of flow of fluid (such as air or tobacco smoke) through the perforations 16a in the wrappers of the respective articles 3. This is necessary because, even though the permeability of the wrappers of articles 3 is known (because the combined area of perforations 16a can be determined by the perforating apparatus with a high degree of accuracy), the filler of the article will influence the rate of flow of fluid through the perforations 16a of the finished article.

In accordance with a presently preferred embodiment, the chamber 17 is designed, dimensioned and mounted to confine the ventilation zone 16 of an oncoming article 3 already in that portion of the path of articles with their flutes 2 which immediately precedes the path portion at the testing station 6. Thus, the chamber 17 extends along the just discussed path upstream of the testing station 6, namely counter to the direction (arrow 4) of advancement of articles 3 toward the testing station, i.e., into register with the hole 14 of the shoe 12.

The testing apparatus further comprises an evaluating circuit 21 having a signal dividing or quotient forming unit 22 which converts the signals $P_P$ (from the transducer 13) and $P_K$ (from the transducer 19) into signals denoting the quotient of $P_P$ and $P_K$. The output of the signal dividing unit 22 is connected with the input of a signal multiplying unit 23 which multiplies the quotient $P_P/P_K$ by the factor of 100 to thus generate a signal V which is indicative of the so-called degree of ventilation (i.e., of the rate of fluid flow through the ventilation zone 16 of the respective article 3) in percent.

The signals V can be utilized to merely display the ascertained rate of fluid flow through the ventilation zones 16 of the tested articles 3 and/or to influence the making of the next-following articles in a filter tipping or filter rod making machine. For example, signals V which are transmitted by the multiplying unit 23 of the evaluating circuit 21 can be used to alter the operation of the apparatus which is used to make perforations 16a in the wrappers of the articles 3. Still further, signals V which are generated by the multiplying unit 23 can be used to segregate articles with unsatisfactory ventilation zones 16 (namely with ventilation zones which do not permit the flow of a fluid (such as air) into the filter mouthpieces of articles 3 at a desired optimum rate) from the remaining (satisfactory) articles. Such segregation can be carried out in addition to or in lieu of adjustment of the perforating apparatus. Apparatus for making perforations in the wrappers of cigarettes and other rod-shaped articles of the tobacco processing industry are disclosed in numerous United States and foreign patents of the assignee of the present application. Reference may be had, for example, to U.S. Pat. No. 4,121,595 granted Oct. 24, 1978 to Heitmann et al.

In order to further enhance the accuracy of the testing operation, the apparatus can be equipped with means for maintaining the pressure in the chamber 17 at a constant value, at least in the course of each testing operation. This can be achieved by connecting the output of the transducer 19 with one input of a signal comparing stage 24, another input of which is connected with the output of a source 26 of reference signals denoting the desired constant pressure in the chamber 17. The output of the signal comparing stage 24 is connected with a pressure regulator 27 (e.g., an adjustable flow restrictor) which is installed in the conduit between the pressure generating device 18 and the chamber 17 to alter the pressure in the chamber 17 whenever the monitored pressure (as ascertained by the transducer 19) deviates from the desired pressure (as indicated by the reference signal from 26). The stage 24 transmits to the pressure regulator 27 a signal whenever it ascertains that the intensity and/or other characteristics of the reference signal from 26 deviate from the corresponding characteristic(s) of a signal from the transducer 19.

The evaluating circuit 21 can be simplified, without affecting the accuracy of signals V, if the pressure in the chamber 17 is constant during testing of successive articles 3 at the station 6. Thus, it is then possible to apply to one input of the dividing or quotient forming unit 22 a signal K which is a constant and is indicative of selected constant pressure in the chamber 17. The source 26 of reference signals then includes a second output (indicated in FIG. 1 by a broken line) which is connected with the input of a function generator 28. The latter modifies the signal K as a function of the selected reference signal from 26 to the signal comparing stage 24. The unit 23 of the evaluating circuit 21 then generates signals V in accordance with a simplified equation $V = P_P/K.100$, wherein $P_P$ is the pressure at the end of an article which is nearer to the ventilation zone 16 and K is the aforediscussed constant indicating the constant pressure in the chamber 17.

The function generator 28 and its connections to the source 26 of reference signals as well as to the signal dividing unit 22 of the evaluating circuit 21 are optional features of the improved apparatus and, therefore, such parts are shown in FIG. 1 by broken lines.

FIG. 2 is an enlarged fragmentary sectional view of the testing apparatus, substantially as seen in the direction of arrows from the line II—II in FIG. 1, i.e., through the testing station 6 in a plane including the axis of rotation of the drum-shaped body 7 of the testing conveyor 1. The testing apparatus is installed in a filter tipping machine wherein plain cigarettes and filter mouthpieces are assembled into filter cigarettes of unit length or multiple unit length. It is customary to produce filter cigarettes of double unit length wherein a filter mouthpiece of double unit length is located between a pair of plain cigarettes of unit length. Such filter cigarettes are thereupon severed midway across their filter mouthpieces to yield pairs of filter cigarettes of unit length. One filter cigarette of each pair is turned end-for-end and is placed between two unturned filter cigarettes of unit length to thus form a single row of parallel filter cigarettes of unit length which are ready to be tested in the improved apparatus. A filter tipping machine which can embody the improved apparatus, or which can supply filter cigarettes of unit length to the improved apparatus, is disclosed for example in commonly owned U. S. Pat. No. 4,280,187 granted July 21, 1981 to Reuland et al. Testing of ventilation zones 16 can constitute but one of several testing operations which are normally carried out in a filter tipping machine. For example, filter cigarettes can be tested for the presence or absence of filter mouthpieces and/or tobacco-containing portions, for open seams and/or other leaks in their wrappers, for the density of their tobacco-containing portions, for the density of their tobacco-containing ends, for the resistance to flow of tobacco smoke from the lighted end toward the other end, for the presence of frayed ends of their wrappers, for the presence of blemishes on the external surfaces of their wrappers and/or for the presence or absence of printed matter (such as the trademark of the manufacturer and/or the brand name of the cigarette).

Articles 3 are held in their respective flutes 2 by suction which is applied via channels 31 in the body 7 of the testing conveyor 1. The channels 31 extend substantially radially of the body 7, and their inner ends communicate with a channel 29 which is machined into a stationary shaft 32 in the frame of the filter tipping machine. One end portion of the shaft 32 extends axially beyond the body 7, and this shaft contains antifriction bearings 33 for a drive shaft 34 which carries a flange 36 serving to transit torque to the body 7 through the medium of a set of screws 37, bolts or other suitable fasteners.

The shaft 32 cooperates with a sleeve 39 to mount ring-shaped supports 42 for antifriction bearings 44. The sleeve 39 is affixed to a lever 38 which is mounted in the frame of the filter tipping machine. The shaft 32 is provided with a first key 41 for the left-hand support 42 of FIG. 2, and the sleeve 39 carries a similar key 41 for the right-hand support 42. The inner races of the bearings 44 surround inclined seats 43 which are machined into the respective supports 42, and the outer races of the bearings 44 are surrounded by the respective tilting or wobble plates 8*a* and 8*b*. The inclination of the axes of seats 43 relative to the axis of the drum-shaped body 7 of the testing conveyor 1 is such that the sealing elements 9 of the plates 8*a*, 8*b* approach each other and the articles 3 in the flutes 2 between pairs of sealing elements while the sealing elements travel toward the testing station 6, and that the sealing elements 9 on the plate 8*a* move axially and away from the aligned sealing elements 9 on the plate 8*b* (and vice versa) while moving beyond the testing station. This renders it possible to readily introduce articles 3 into the flutes 2 ahead of the testing station and to readily remove or expel tested articles downstream of or past the testing station. All this is fully described in the aforementioned U.S. Pat. No. 3,948,084 to Heitmann et al. The inclination of the plane of the plate 8*a* relative to the axis of the body 7 preferably matches the inclination of the plane of the plate 8b. The shoes 12 and 12*a* are rigidly connected with the respective supports 42 by means of links 46 and abut the outer sides of the respective plates 8*b* and 8*a*.

The plates 8*a* and 8*b* are connected with the drum-shaped body 7 of the conveyor 1 coupling pins 47 which have freedom of radial movement in radially extending slots 48 provided therefor in the adjacent end faces of the body 7. This enables the plates 8*a* and 8*b* to change their inclination with reference to the axis of the shaft 32 during predetermined stages of each revolution of the drive shaft 34. FIG. 2 further shows coil springs 49 which react against the end faces of the body 7 and bear against the adjacent plates 8*a*, 8*b* to urge the plates against the respective shoes 12*a* and 12. The springs 49 store energy when they approach the testing station 6, and they are free to dissipate energy while advancing beyond and away from the testing station. The two annuli of sealing elements 9 travel along their respective paths to properly engage the respective ends of the articles 3 not later than at the testing station 6. At such time, the transducer 13 generates signals which indicate the rate of flow of air from the perforations 16*a* toward the adjacent ends of the articles 3 and into the respective holes 11 of the plate 8*b* whence the air flows through the bore 14 of the shoe 12 and into the transducer 13. The other end of the article 3 at the testing station 6 communicates with the atmosphere by way of the left-hand sealing element 9, a bore or hole 52 in the plate 8*a*, a groove 53 in the inner side of the shoe 12*a*, and a radially outwardly extending bore or hole 54 in the shoe 12*a*.

FIG. 2 further shows that the chamber 17 surrounds the ventilation zone 16 of the article 3 at the testing station 6. This renders it possible to individually ascertain the rate of fluid flow through the ventilation zone 16 of each individual article 3, i.e., it is possible to individually segregate those articles which are unacceptable because of an unsatisfactory rate of flow of fluid through their perforations 16*a*. The transducer 13 of FIGS. 1 and 2 is replaced with a transducer which generates signals denoting subatmospheric pressure if the pressure generating device 18 is replaced with a suction generating device to draw air from the chamber 17. All that counts is to ensure that the chamber 17 induces the flow of air from the right-hand sealing element 9 toward the perforations 16*a* of the article 3 at the station 6 or in the opposite direction. In other words, the chamber 17 must apply around the perforations 16*a* of the article 3 at the station 6 a pressure which departs from atmospheric pressure. The resulting pressure differential between the interior and the exterior of the article 3 in the region of the ventilation zone 16 is indicative of the rate of fluid flow through the perforations 16*a*.

It has been found that the apparatus permits highly accurate determination of the degree of ventilation in a very simple and efficient way as well as without affecting the accuracy of other tests which are, or which can be, carried out upon articles 3 on the conveyor 1.

The provision of a chamber 17 which surrounds the ventilation zones 16 of successive articles 3 as well as at least slightly ahead of the testing station 6 contributes to reliability and accuracy of the testing operation because the chamber 17 can establish predictable conditions in the region around the ventilation zone not later than when the respective article reaches the testing station. The pressure regulator 27 can be designed to permit the application of pressure to the interior of the chamber 17 or to permit evacuation of air from the interior of the chamber as soon as the chamber properly confines the ventilation zone of an article which approaches or which has reached the testing station.

The transducer 19 constitutes an optional but desirable component of the apparatus. The same applies for the signal comparing stage 24, i.e., for the means for maintaining the pressure in the chamber 17 at a constant value.

The pressure in the chamber 17 can vary from measurement to measurement if the apparatus embodies the transducer 19 or an analogous chamber pressure monitoring device which is capable of ascertaining the pressure in the chamber 17 whenever a fresh article 3 reaches the testing station 6.

Figure 3:
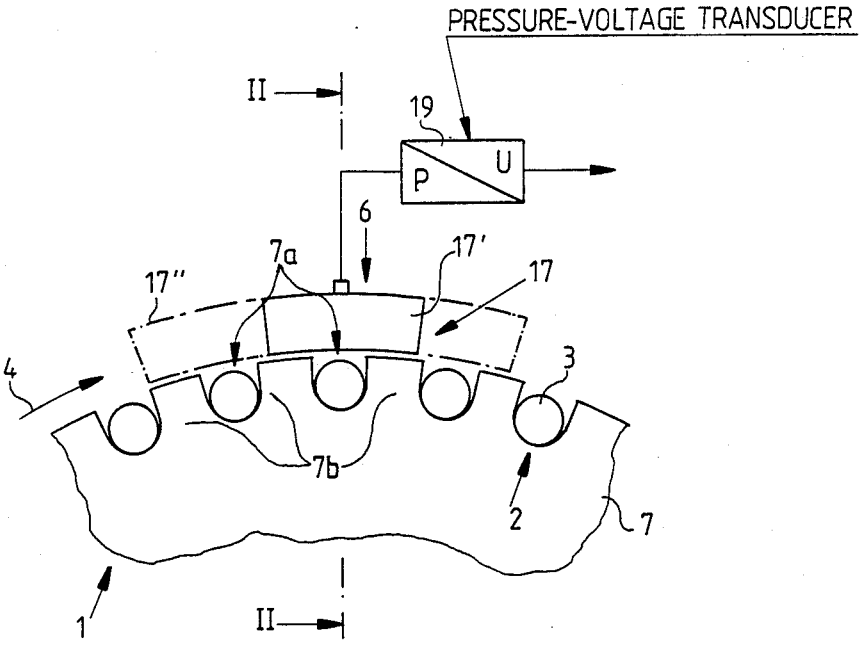
FIG. 3 is a fragmentary and elevational view of the transporting means in the apparatus of FIG. 2.

One presently preferred chamber 17 is shown in FIG. 3. This chamber includes a mobile portion constituted by rather pronounced webs or ribs 7*b* alternating with relatively deep portions 7*a* of flutes 2 in the regions of ventilation zones 16 of articles 3 in the respective flutes 2. A stationary portion 17' of the chamber 17 is a shroud which overlies the adjacent ribs 7*b* at the testing station 6 to at least substantially seal the surrounding atmosphere from the ventilation zone 16 of the article 3 which registers with the bore 14 of the shoe 12.

As the conveyor 1 rotates, the drum-shaped body 7 advances successive articles 3 to the testing zone 6 where the ventilation zones 16 of such articles are overlapped by the shroud 17' which cooperates with the ribs 7*b* flanking the ventilation zone 16 at the station 6 to seal such ventilation zone from the surrounding atmosphere while the device 18 draws air from or pumps air into the area around the thus confined ventilation zone 16 and the transducer 19 generates a signal denoting the pressure $P_K$. The transducer 19 and/or the evaluating circuit 21 is preferably calibrated to account for leakage (if any) of air between the shroud 17' the adjacent ribs *7b* at the testing station 6. It will be noted that the portions *7a* of flutes 2 are sufficiently deep to permit the top lands of the ribs *7b* to travel in immediate proximity of the concave inner side of the shroud 17' while advancing past the testing station 6. This ensures that leakage of air between the interior of the chamber 17 and the surrounding atmosphere is negligible or minimal so that it cannot appreciable influence the testing operation even if it is not compensated for by the transducer 19 and/or by the evaluating circuit 21. Leakage, if any, between the interior of the chamber 17 and the surrounding atmosphere is constant, i.e., it is the same for each of a short or long series of articles 3 which are being tested at the station 6.

The length of the deep portions *7a* of flutes 2 (as seen in the axial direction of the body 7) can be selected with a view to ensure that the portions *7a* merely receive the ventilation zones 16 of the respective articles 3. This is shown in FIG. 2 wherein the axial length of the rib *7b* which is indicated therein by solid line is such that the rib *7b* extends only slightly beyond both sides of the illustrated annulus of perforations in the wrapper of the mouthpiece forming part of the filter cigarette 3 at the station 6. However, it is equally within the purview of the invention to employ flutes 2 with relatively long ribs flanking deep recesses for articles 3. This is indicated in FIG. 2 by broken lines, as at *7c* to show that the ribs can extend all the way between the two end faces of the drum-shaped boy 7 of the testing conveyor 1.

FIG. 3 shows by solid lines a relatively short shroud 17' which overlaps only two neighboring ribs *7b* at the testing station 6. This ensures individual determination of pressure in each flute 2 as soon as the flute 2 (and more particularly its deep portion *7a*) reaches the testing station 6. If the pressure (be it subatmospheric or superatmospheric) is to be built up while an article 3 approaches the testing station 6, the relatively short shroud 17' (as measured in the direction of arrow 4) is replaced with a longer shroud 17'' (indicated in FIG. 3 by phantom lines) which extends counter to the direction of arrow 4 beyond the testing station 6 so that its concave inner side can simultaneously overlie more than two neighboring ribs or webs *7b*. This renders it possible to dispense with the pressure-voltage transducer 19. The longer shroud 17'' will be used if it suffices to ascertain an average rate of fluid flow (signal V) for the ventilation zones of two or more successive articles 3.

The bore 18*a* in the body 7 of the conveyor 1 which is shown in FIG. 2 denotes the path for the flow of air between the flute 2 at the testing station 6 and the device 18. One such bore 18*a* is provided in the body 7 for each flute 2, and these bores can communicate with the device 18, while moving past the station 6, by way of a suitable valve plate (not shown) which abuts the right-hand end face of the body 7.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of ascertaining the rate of fluid flow through the wrappers of a series of rod-shaped articles of the tobacco processing industry, particularly filter cigarettes, wherein the wrappers have ventilation zones and the ventilation zones exhibit a predetermined permeability to fluids, comprising the steps of transporting the articles seriatim in a predetermined direction along a predetermined path; sealing the ventilation zones of successive articles from the surrounding atmosphere not later than in a predetermined portion of said path; applying to the sealed ventilation zones an external pressure which differs from atmospheric pressure; monitoring the pressure at one end of each of said series of articles in said portion of said path; generating first signals denoting the monitored pressure, said first signals being indicative of the rate of fluid flow through the respective ventilation zones; monitoring said external pressure; generating second signals denoting the monitored external pressure; and converting said second signals and the respective first signals into third signals denoting the rate of fluid flow through the ventilation zones.

2. The method of claim 1, wherein said sealing step comprises confining the ventilation zones of successive articles in a chamber, said pressure applying step including maintaining the interior of the chamber at a pressure other than atmospheric pressure.

3. The method of claim 2, wherein said sealing step comprises confining the ventilation zones of successive articles in the chamber and sealing the chamber from the atmosphere when the articles therein reach said predetermined portion of said path.

4. The method of claim 2, wherein said sealing step comprises confining the ventilation zones of successive articles in the chamber before the articles reach said predetermined portion of said path.

5. The method of claim 4, wherein said pressure applying step includes changing the pressure in the chamber while an article having its ventilation zone in the closed chamber is being transported toward said predetermined portion of said path.

6. The method of claim 1, wherein said converting step includes determining the rate of fluid flow in accordance with the equation $$V = P_P/P_K.100\%$$

wherein V is the rate of fluid flow in percent, $P_P$ is monitored pressure at the ends of the articles, and $P_K$ is the monitored external pressure.

7. The method of claim 1, wherein said pressure applying step includes applying to the sealed ventilation zones a predetermined constant pressure, and further comprising the step of determining the rate of fluid flow in accordance with the equation $$V = P_P/K.100\%$$

wherein V is the rate of fluid flow in percent, $P_P$ is the monitored pressure, and K is a constant denoting said constant pressure.

8. The method of claim 1 of ascertaining the rate of fluid flow through the ventilation zones of rod-shaped articles of the type having a first end nearer to and a second end more distant from the ventilation zone, said step of monitoring the pressure of said series of articles in said portion of said path including measuring the pressure at the first ends of the articles.

* * * * *